US009447537B2

(12) United States Patent
Wisherd et al.

(10) Patent No.: US 9,447,537 B2
(45) Date of Patent: Sep. 20, 2016

(54) FIXED RADIAL ANODE DRUM DRYER

(71) Applicant: Cool Dry, Inc., San Jose, CA (US)

(72) Inventors: David S. Wisherd, Carmel, CA (US); John Alan Eisenberg, Los Altos, CA (US); Michael Andrew Wohl, Talbott, TN (US); Pablo Eugenio D'Anna, Santa Barbara, CA (US)

(73) Assignee: COOL DRY, INC., San Jose, CA (US)

( * ) Notice: Subject to any disclaimer, the term of this patent is extended or adjusted under 35 U.S.C. 154(b) by 0 days.

(21) Appl. No.: 14/878,374

(22) Filed: Oct. 8, 2015

(65) Prior Publication Data

US 2016/0130743 A1 May 12, 2016

Related U.S. Application Data

(60) Provisional application No. 62/123,274, filed on Nov. 12, 2014.

(51) Int. Cl.
*F26B 3/34* (2006.01)
*H05B 6/54* (2006.01)
(Continued)

(52) U.S. Cl.
CPC ..... *D06F 58/266* (2013.01); *D06F 58/04* (2013.01); *F26B 3/343* (2013.01); *H05B 6/62* (2013.01)

(58) Field of Classification Search
CPC ..... F26B 3/353; F26B 3/34; F26B 3/343; F26B 11/0495; D06F 58/226; D06F 58/26; H01L 21/762; H05B 6/54; H05B 6/62
USPC ..... 34/255, 259–261, 265; 219/764–780
See application file for complete search history.

(56) References Cited

U.S. PATENT DOCUMENTS 2,472,193 A 6/1949 Clayton
2,511,839 A 6/1950 Frye
(Continued)

FOREIGN PATENT DOCUMENTS

EP 0 862 218 A1 9/1998
EP 1 753 265 A1 2/2007
(Continued)

OTHER PUBLICATIONS

International Search Report (ISA/US) and Written Opinion mailed Feb. 19, 2016 for international patent application PCT/US2015/058462 filed Oct. 30, 2015, 7 pages.
(Continued)

*Primary Examiner* — Kenneth Rinehart
*Assistant Examiner* — John McCormack
(74) *Attorney, Agent, or Firm* — Edward J. Radlo; Radlo IP Law Group

(57) ABSTRACT

A clothes dryer apparatus (99) comprising an electrically conductive, grounded, generally cylindrical rotatable drum (13) having a hollow interior adapted to contain a load (15) of wet clothes to be dried. The drum's (13) exterior surface (27) is partially indented to form one or more integral, generally ring-shaped insulated notches (10). An electrically conductive, generally flat arcuate anode (11) is positioned within each notch (10), with no physical contact between an anode (11) and its corresponding notch (10). Each anode (11) is spatially fixed with respect to the rotatable drum (13), and is electrically isolated from conductive portions of the drum (13). A source (21) of RF power (12), operating at a single fixed frequency, is coupled to each anode (11).

23 Claims, 11 Drawing Sheets

(51) Int. Cl.

| | |
|---|---|
| ***D06F 58/26*** | (2006.01) |
| ***H05B 6/62*** | (2006.01) |
| ***D06F 58/04*** | (2006.01) |

(56) References Cited

U.S. PATENT DOCUMENTS

| | | | |
|---|---|---|---|
| 3,605,272 | A | 9/1971 | Boucher |
| 3,643,349 | A | 2/1972 | Zenz |
| 3,854,219 | A | 12/1974 | Staats |
| 3,866,255 | A | 2/1975 | Serota |
| 3,938,260 | A | 2/1976 | Brenner et al. |
| 4,000,340 | A | 12/1976 | Murphy et al. |
| 4,126,563 | A | 11/1978 | Barker |
| 4,250,628 | A | 2/1981 | Smith et al. |
| 4,314,805 | A | 2/1982 | McKnight |
| 4,334,136 | A | 6/1982 | Mahan et al. |
| 4,356,640 | A | 11/1982 | Jansson |
| 4,490,923 | A | 1/1985 | Thomas |
| 5,152,075 | A | 10/1992 | Bonar |
| 5,463,821 | A | 11/1995 | Gauer |
| 5,712,469 | A | 1/1998 | Chaffin et al. |
| 5,869,817 | A | 2/1999 | Zietlow et al. |
| 5,983,520 | A | 11/1999 | Kim et al. |
| 6,124,624 | A | 9/2000 | Van Roosmalen et al. |
| 6,141,634 | A | 10/2000 | Flint et al. |
| 6,272,770 | B1 | 8/2001 | Slutsky et al. |
| 6,344,638 | B1 | 2/2002 | Tomasello |
| 6,417,499 | B2 | 7/2002 | Blaker et al. |
| 6,423,955 | B1 | 7/2002 | Blaker et al. |
| 6,657,173 | B2 | 12/2003 | Flugstad et al. |
| 6,825,618 | B2 | 11/2004 | Pu et al. |
| 6,914,226 | B2 | 7/2005 | Ottaway |
| 6,971,189 | B1 | 12/2005 | Anibas |
| 7,034,266 | B1 | 4/2006 | DeGroot et al. |
| 7,325,330 | B2 | 2/2008 | Kim et al. |
| 7,380,423 | B1 | 6/2008 | Musone |
| 7,933,733 | B2 | 4/2011 | Ashrafzadeh et al. |
| 8,035,255 | B2 | 10/2011 | Kurs et al. |
| 8,058,588 | B2 | 11/2011 | Gagas et al. |
| 8,215,133 | B2 | 7/2012 | Kim et al. |
| 8,405,467 | B2 | 3/2013 | He |
| 8,826,561 | B2 | 9/2014 | Wisherd et al. |
| 8,943,705 | B2 | 2/2015 | Wisherd et al. |
| 9,173,253 | B2 | 10/2015 | Wohl et al. |
| 9,200,402 | B2 | 12/2015 | Wisherd et al. |
| 2001/0035342 | A1 | 11/2001 | Morse et al. |
| 2002/0047009 | A1 | 4/2002 | Flugstad et al. |
| 2003/0224965 | A1 | 12/2003 | Conley et al. |
| 2004/0031731 | A1 | 2/2004 | Honeycutt et al. |
| 2004/0261286 | A1 | 12/2004 | Green et al. |
| 2006/0109327 | A1 | 5/2006 | Diamond et al. |
| 2007/0033829 | A1 | 2/2007 | Kim |
| 2007/0045307 | A1 | 3/2007 | Tsui et al. |
| 2007/0085689 | A1 | 4/2007 | Brommer et al. |
| 2007/0163144 | A1 | 7/2007 | Dittmer et al. |
| 2007/0251118 | A1 | 11/2007 | Doh |
| 2007/0271814 | A1 | 11/2007 | Bae et al. |
| 2008/0307667 | A1 | 12/2008 | Ikemizu |
| 2009/0236334 | A1 | 9/2009 | Ben-Shmuel et al. |
| 2009/0255145 | A1 | 10/2009 | Poy |
| 2009/0272004 | A1 | 11/2009 | Chernetski et al. |
| 2010/0115708 | A1 | 5/2010 | Caswell et al. |
| 2010/0115785 | A1 | 5/2010 | Ben-Shmuel et al. |
| 2010/0166818 | A1 | 7/2010 | Troutman |
| 2010/0236088 | A1 | 9/2010 | Paice |
| 2011/0067186 | A1 | 3/2011 | Johansson |
| 2011/0146102 | A1 | 6/2011 | Bellinetto et al. |
| 2011/0308101 | A1 | 12/2011 | Wisherd et al. |
| 2012/0096737 | A1 | 4/2012 | Kmet et al. |
| 2012/0125909 | A1 | 5/2012 | Scheunert et al. |
| 2012/0291304 | A1 | 11/2012 | Wisherd et al. |
| 2013/0119055 | A1 | 5/2013 | Wohl et al. |
| 2014/0325865 | A1 | 11/2014 | Wisherd et al. |
| 2015/0020403 | A1 | 1/2015 | Herman et al. |
| 2015/0047218 | A1 | 2/2015 | Herman et al. |
| 2015/0047219 | A1 | 2/2015 | Lee et al. |
| 2015/0051738 | A1 | 2/2015 | Lee et al. |
| 2015/0052774 | A1 | 2/2015 | Herman et al. |
| 2015/0052775 | A1 | 2/2015 | Herman et al. |
| 2015/0089829 | A1 | 4/2015 | Herman et al. |
| 2015/0101207 | A1 | 4/2015 | Herman et al. |

FOREIGN PATENT DOCUMENTS

| | | | |
|---|---|---|---|
| GB | 835454 | A | 5/1960 |
| WO | 97/32071 | A1 | 9/1997 |
| WO | 03/019985 | A1 | 3/2003 |
| WO | 2011/159462 | A1 | 12/2011 |
| WO | 2012/161889 | A1 | 11/2012 |
| WO | 2013/074262 | A1 | 5/2013 |
| WO | 2014/104451 | A1 | 7/2014 |

OTHER PUBLICATIONS

International Search Report (ISA/US) mailed Sep. 15, 2011 for international patent application PCT/US2011/038594 filed May 31, 2011, 3 pages.

Written Opinion of the International Searching Authority (ISA/US) mailed Sep. 15, 2011 for international patent application PCT/US2011/038594 filed May 31, 2011, 15 pages.

International Search Report (ISA/US) mailed Aug. 3, 2012 for international patent application PCT/US2012/033900 filed Apr. 17, 2012, 4 pages.

Written Opinion of the International Searching Authority (ISA/US) mailed Aug. 3, 2012 for international patent application PCT/US2012/033900 filed Apr. 17, 2012, 6 pages.

International Search Report (ISA/US) mailed Jan. 25, 2013 for international patent application PCT/US2012/061736 filed Oct. 24, 2012, 3 pages.

Written Opinion of the International Searching Authority (ISA/US) mailed Jan. 25, 2013 for international patent application PCT/US2012/061736 filed Oct. 24, 2012, 5 pages.

"Specification sheet for 1 KW Class E Module PRF-1150 power module, © 2002 Directed Energy, Inc., downloaded on Mar. 17, 2014 from: http://ixys.com/SearchResults.aspx?search=class+E&SearchSubmit=Go, 17 pages".

Wilson et al., Radio-Frequency Dielectric Heating in Industry, Thermo Energy Corporation, Palo Alto, California, Final Report, Mar. 1987. Retrieved from Internet: URL: http://infohouse.p2ric.org/ref/39/38699.pdf.

FIXED RADIAL ANODE DRUM DRYER

RELATED APPLICATIONS

This patent application claims the priority benefit of commonly owned U.S. provisional patent application Ser. No. 62/123,274 filed Nov. 12, 2014; said U.S. provisional patent application and U.S. patent application Ser. No. 13/297,282 filed Nov. 16, 2011 and published as US 2013/0119055 A1 on May 16, 2013 are hereby incorporated by reference into the present patent application in their entireties.

TECHNICAL FIELD

This invention pertains to the field of drying a load of clothes using dielectric heating.

BACKGROUND ART

Dielectric heating involves the heating of materials by dielectric loss. A changing electric field across the dielectric material (in this case, a load of clothes) causes energy to be dissipated as the molecules attempt to line up with the continuously changing electric field, creating friction. This changing electric field may be caused by an electromagnetic wave propagating in free space as in a microwave oven, or it may be caused by a rapidly alternating electric field inside a capacitor, as in the present invention. In the latter case, there is no freely propagating electromagnetic wave. This changing electric field may be seen as analogous to the electrical component of an antenna near field.

Frequencies in the RF range of 1 MHz to 50 MHz have been used to cause efficient dielectric heating in some materials, especially liquid solutions with polar salts dissolved. These relatively low frequencies can have significantly better heating effects than higher, e.g., microwave frequencies, due to the physical heating mechanisms. For example, in conductive liquids such as salt water, "ion drag" from using lower RF frequencies causes heating, as charged ions are "dragged" more slowly back and forth in the liquid under influence of the electric field, striking liquid molecules in the process and transferring kinetic energy to them, which is eventually translated into molecular vibrations, and thus into thermal energy.

Dielectric heating at these low frequencies, as a near-field effect, requires a distance from the radiator to the absorber of less than about 1/16th of a wavelength (λ) of the source frequency. It is thus a contact process or near-contact process, since it usually sandwiches the material to be heated (usually a non-metal) between metal plates that set up to form what is effectively a very large capacitor, with the material to be heated acting as a dielectric inside the capacitor. Actual electrical contact between the capacitor plates and the dielectric material is not necessary, as the electrical fields that form inside the plates are what cause the heating of the dielectric material. However, the efficient transfer of the RF heating energy to the load is greatly improved as the air gap that may arise between the capacitor plates and the load is minimized.

At higher frequencies, e.g., microwave frequencies>800 MHz, the wavelength of the electromagnetic field becomes closer to the distance between the metal walls of the heating cavity, or to the dimensions of the walls themselves. This is the case inside the cavity of a microwave oven. In such cases, conventional far-field electromagnetic (EM) waves form; and the enclosure no longer acts as a pure capacitor, but rather as a resonant cavity. The EM waves are absorbed into the load to cause heating. The dipole-rotation mechanism of induced heat generation remains the same as in the case of capacitive electrical coupling. However, microwave induced ion rotation is not as efficient at causing the heating effects as the lower RF frequency fields that depend on slower molecular motion, such as those caused by ion drag.

Novel applications of RF dielectric heating to the drying of clothes have been patented in commonly owned U.S. Pat. Nos. 8,826,561 and 8,943,705, where rotary RF heating capacitive structures are disclosed. These patented inventions require the introduction of specialized connections to both anodes inside the dryer drum and to the drum surface acting as a cathode.

DISCLOSURE OF INVENTION

A clothes dryer apparatus (99) comprising an electrically conductive, grounded, generally cylindrical rotatable drum (13) having a hollow interior adapted to contain a load (15) of wet clothes to be dried. The drum's (13) exterior surface (27) is partially indented to form one or more integral, generally ring-shaped insulated notches (10). An electrically conductive, generally flat arcuate anode (11) is positioned within each notch (10), with no physical contact between an anode (11) and its corresponding notch (10). Each anode (11) is spatially fixed with respect to the rotatable drum (13), and is electrically isolated from conductive portions of the drum (13). A source (21) of RF power (12), operating at a single fixed frequency, is coupled to each anode (11).

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF PREFERRED EMBODIMENTS

Figure 1:
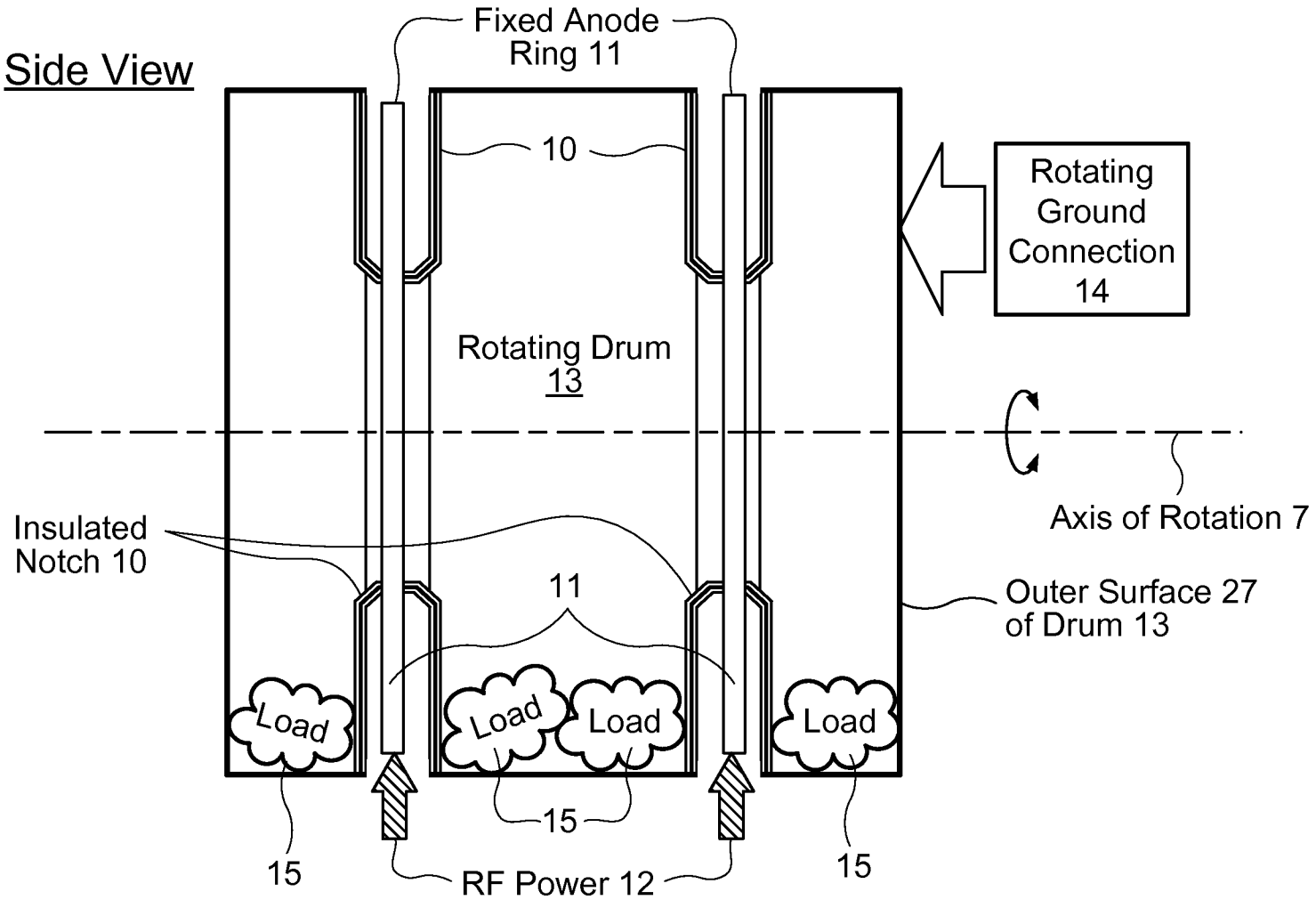
FIG. 1 is a side view of rotating conductive drum 13 of the present invention.

This invention comprises a rotating drum 13 that acts as a cathode of a large capacitor, with simplified connections to the one or more anodes 11 that produce an electric field inside the drum 13. The anodes 11 are spatially fixed, are mounted outside the hollow interior of the drum 13, and protrude into one or more notches 10 that are fabricated as indentations as part of the drum periphery 27. Anodes 11 maintain the necessary electric field contact with a load 15 of clothes inside the rotating drum 13, to effect optimum RF capacitive coupling. The minimization of parasitic capacitance from the anode 11 (where RF is applied) to the cathode drum 13 (which is grounded) is important for energy conversion efficiency when using the present invention's relatively low RF frequency. For this reason, it is desirable for the clothes 15 to be close to both the cathode 13 and to the anode(s) 11. In this patent application, parasitic capacitance is defined as any capacitance between the anode(s) 11 and cathode drum 13 not associated with the capacitance of the load 15 itself.

The present invention's dielectric heating of a load 15 of clothes by a single frequency RF-generated electric current 12 in a rotating cathode drum 13 using at least one spatially fixed, non-rotating, radial anode 11, by creating an AC current flow through the semi-conductive (wet) load 15 of clothes in a capacitive electrical circuit, is in stark contrast to other RF heaters that are based on exciting an electromagnetic field within a microwave cavity.

A rotating connection to an anode is not required or used in the present invention. The benefits of this include: a simpler, more reliable connection between the RF power 12 and the anode(s) 11, lower cost, and lower parasitic anode 11 capacitance compared with prior art devices. The grounded cathode connection 14, 17 to the rotating drum 15 can be capacitive 17 or mechanical 14. The cathode (conductive drum 13) has a large contact surface 27 area with no parasitic capacitance issues when the drum surface 27 is connected 14 directly to ground.

Each fixed anode 11 can be fabricated of bare metal or insulated metal. The insulation may be painted on the anode 11.

The clothes drying process of the present invention may include forcing room temperature or heated air 25 to flow inside the drum 13, to facilitate the removal of moisture from the load 15 of clothes, and for other reasons as described below.

FIG. 1 is a side view of rotating electrically conductive drum 13 showing two insulated radial notches 10. The drum 13 can be made of a conducting material, i.e., metal, or an insulating material that is coated with a conductive layer. Drum 13 is free to rotate in both clockwise and counterclockwise directions about a single axis of rotation 7. Two radial anode rings 11 are positioned in corresponding notches 10. Anodes 11 couple the applied RF electric power 12 into the load 15 of clothes. Load 15 is located between the fixed anode plates 11 and the rotating conductive drum 13.

Two 360-degree generally flat anode rings 11 are shown in FIG. 1, but one or more rings 11 can be shortened to any percentage circumference of 360 degrees. These anode rings 11 are connected in a low-loss manner to an RF power source 12. The rotating conductive drum 13 is shown connected to ground by a direct rotary or capacitive coupling connection 14. Connection 14 can be selectively activated, e.g., only when the RF power 12 is applied, or, alternatively, connection 14 can be continuously connected, e.g., using a "brush" type connection between connection point or strip 14 and a fixed ground mass.

Because the use of spatially fixed radial anode rings 11 eliminates the need for a moving RF anode contact, the single frequency RF power 12 can be easily applied to the anode(s) 11 with low loss, when drum 13 is rotating, when drum 13 is stationary, or when drum 13 is both rotating and stationary. The rotation can have a variable speed, including zero speed (stopped), and can be in either rotational direction.

Figure 2:
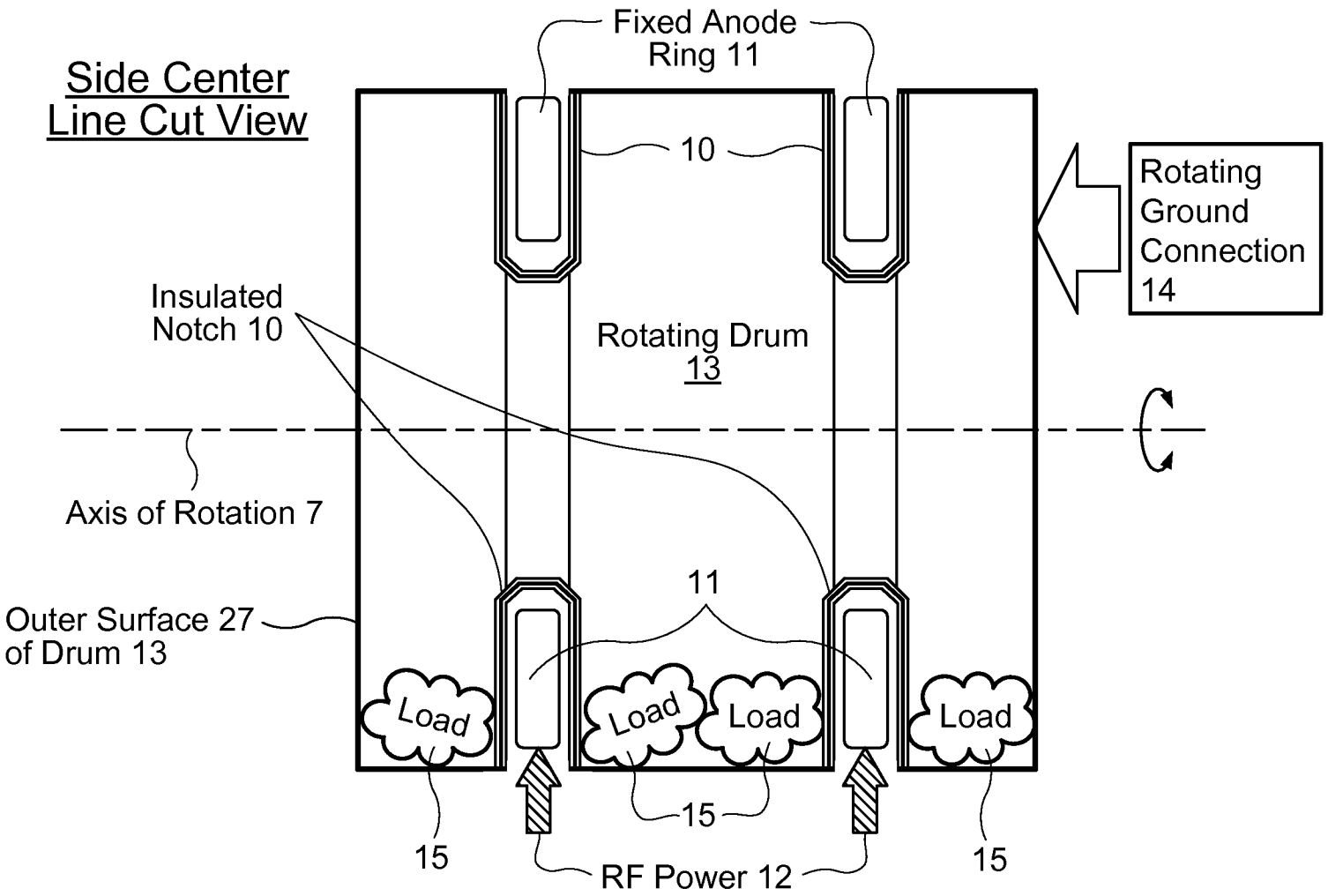
FIG. 2 is a side center-line cutaway view of rotating conductive drum 13.

FIG. 2 is a side center-line cutaway view of the rotating conductive drum 13 of FIG. 1. The two insulated radial notches 10 are positioned with clearance from (i.e., without touching) the fixed anode plates 11, to allow free rotation of the drum 13 in either direction. These insulated notches 10 can be fabricated in a continuous physical structure with surfaces of drum 13.

Figure 3:
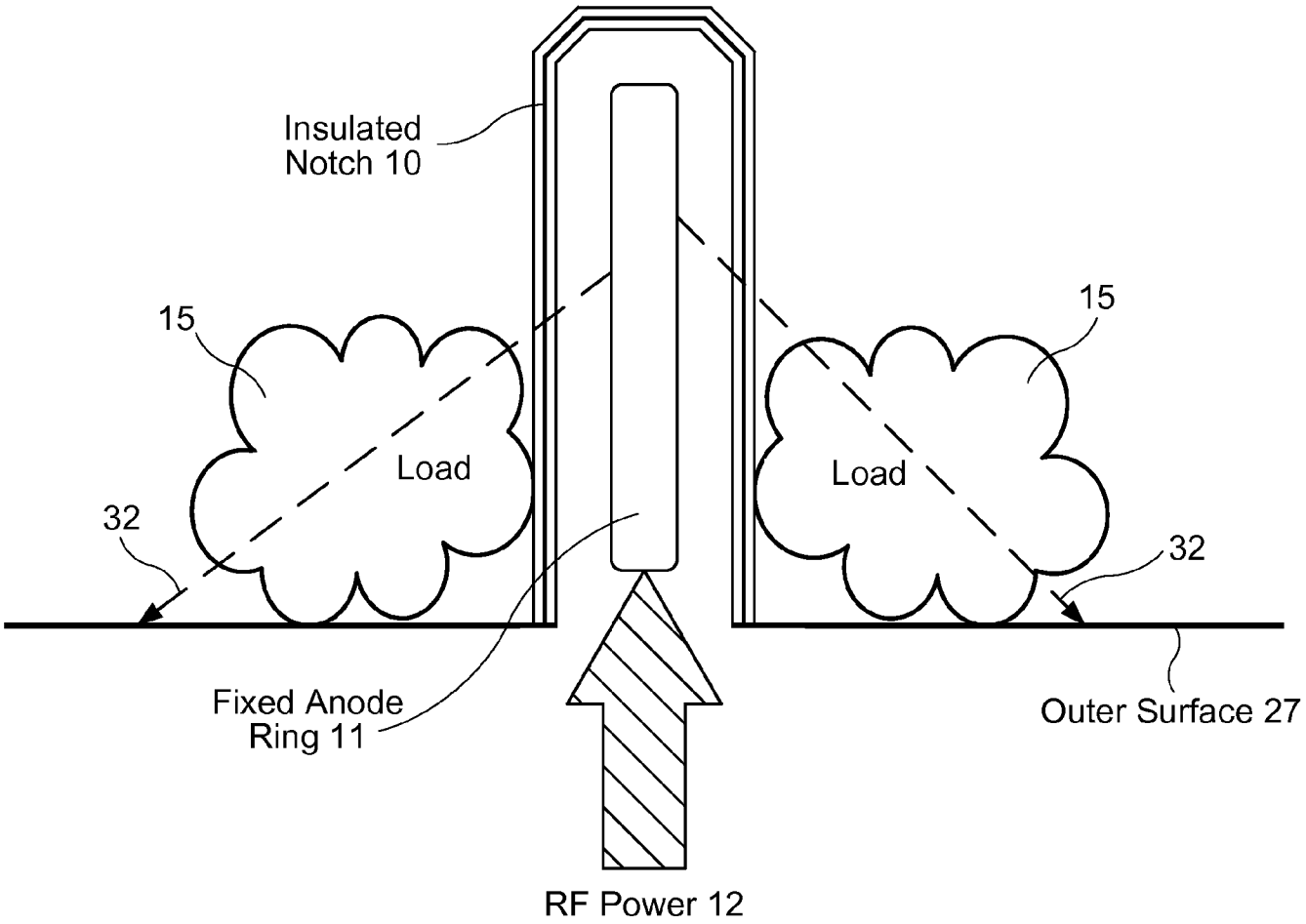
FIG. 3 is a detailed view of a bottom area of drum 13 while drum 13 is in a stationary position.

FIG. 3 is a detailed view of a bottom area of drum 13 while drum 13 is in a stationary position. Notches 10 allow the electric field 32 from the fixed anodes 11 to electrically penetrate into the hollow interior of drum 13. RF power 12 flows through anode ring 11, through insulated notch 10, and through the load 15 of clothes; and finally returns to the conductive surface 27 of grounded cathode drum 13. RF power 12 can be applied when the load 15 of clothes is tumbling, stationary, or when it is both tumbling and stationary. The anode rings 11 are sized to fit the particular application, e.g., their widths and percentages of circular arc can be varied as desired.

Figure 3A:
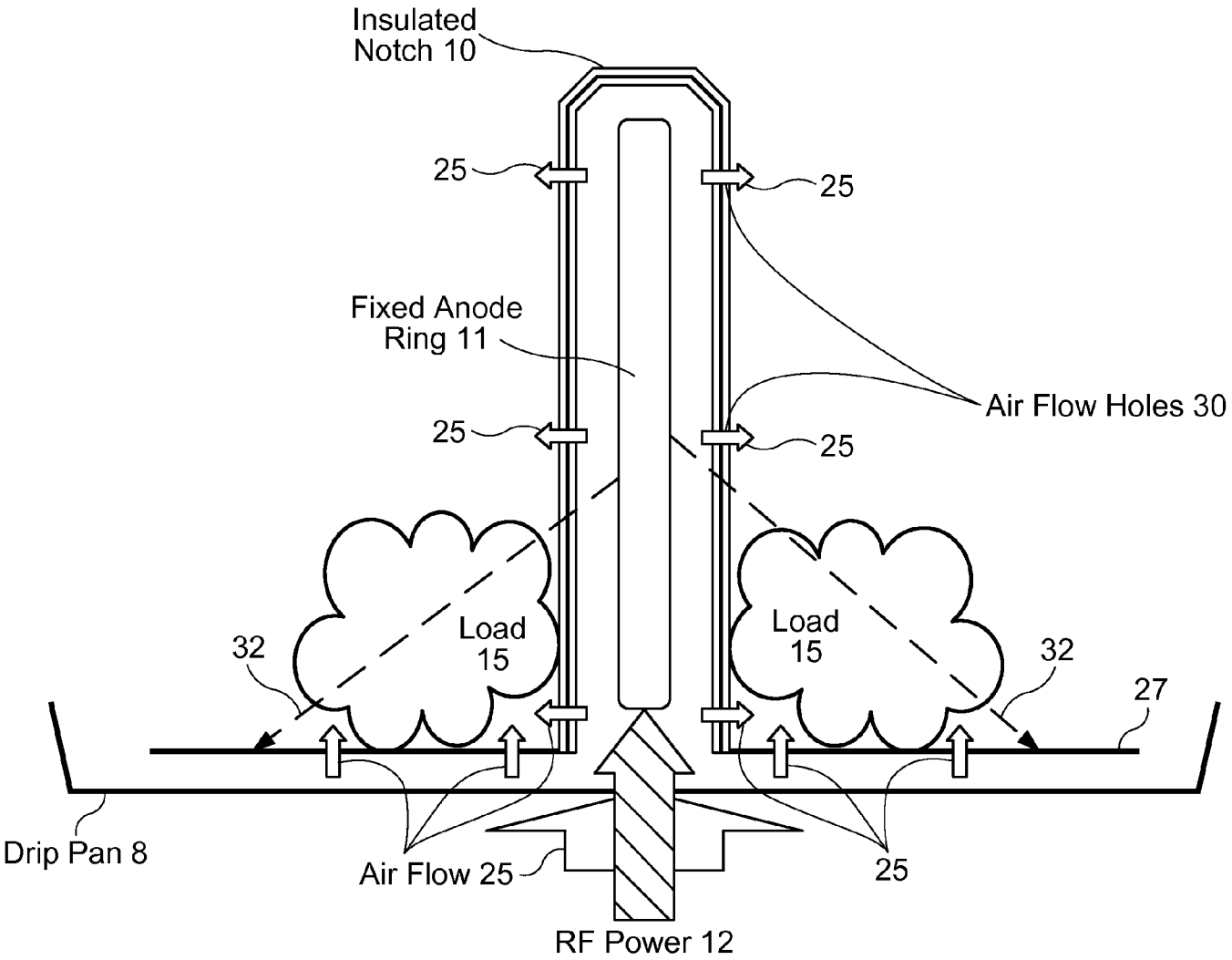
FIG. 3A is a detailed view of an area around an insulated notch 10 in an embodiment of the present invention in which air flow 25 is used.

FIG. 3A is a detailed view of an area around an insulated notch 10 in an embodiment in which air flow 25 is used. The notches 10 rotate with drum 13, and can be integrally fabricated as part of drum 13. Air flow 25 is forced through holes 30 in notch 10 and thus into the hollow interior of drum 13. The primary purpose of the air flow 25 is to remove from the interior of the drum 13 the water that was evaporated from the load 15 by the application of the RF power 12. Air flow 25 can also remove additional moisture from the load 15 by induced direct evaporation, help to cool the anodes 11, and help to cool variable tuning inductor 42 (see FIG. 9). In embodiments in which air flow 25 is used, a drip pan 8 is positioned beneath the drum 13 to catch any water that escapes out of the drum 13 through holes 30.

Figure 4:
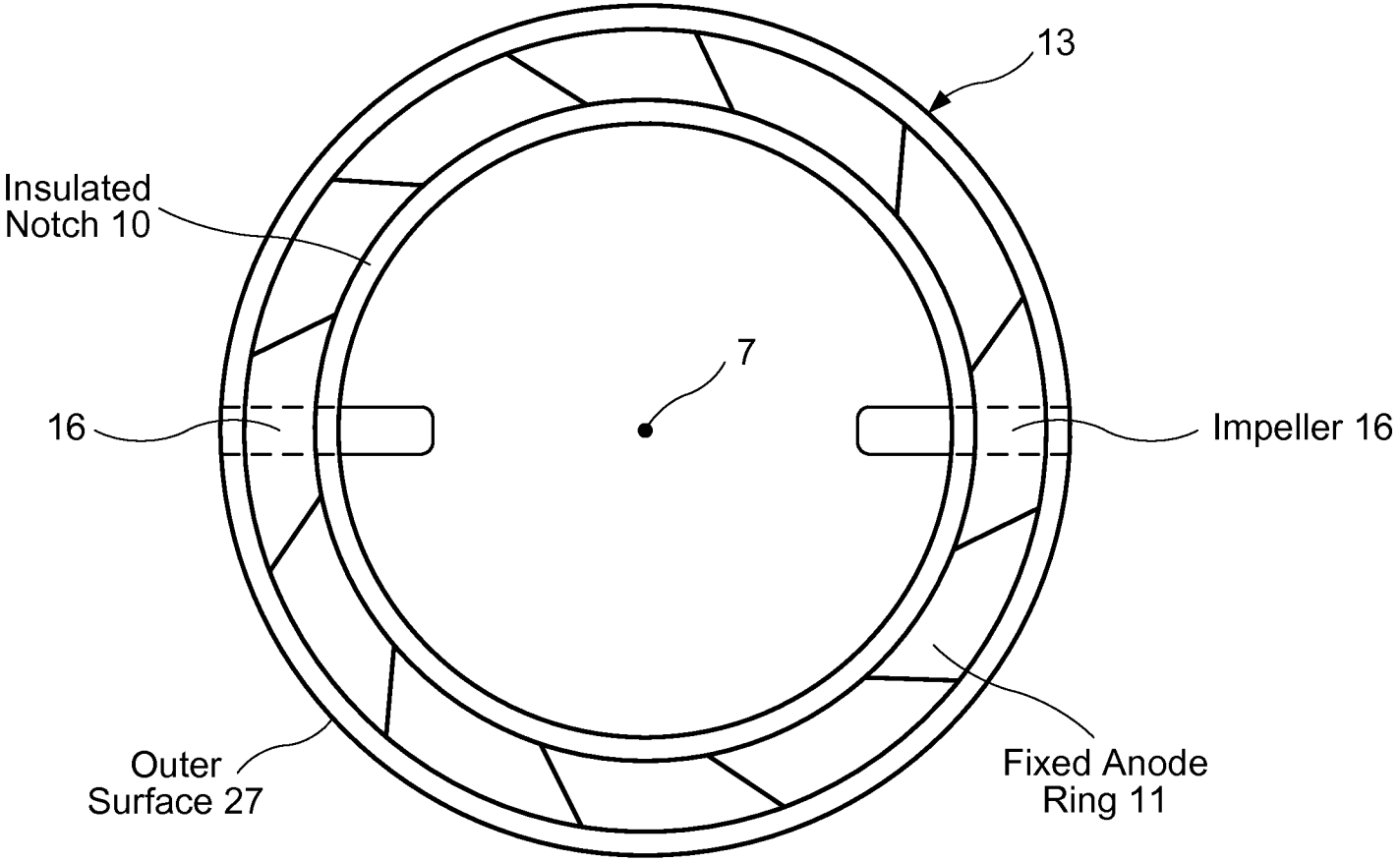
FIG. 4 is a cut-way end view of drum 13 showing a fixed radial anode ring 11 positioned within an insulated notch 10.

FIG. 4 is a cut-away end view of the drum 13 showing a fixed radial anode ring 11 positioned within an insulated notch 10. The radial fixed anode rings 11 are shaped in form, length, and width to maximize capacitive coupling to load 15 and to minimize parasitic, non-load coupled, capacitance to ground 14, 17. Although the anode 11 that is illustrated in FIG. 4 is a full 360 degree ring, the anode rings 11 can be any percentage of 360 degrees of circumference.

Drum 13 can rotate at any speed, including zero speed (stopped), and can rotate in either rotational direction about axis 7. One or more mechanical impellers 16 can be placed inside the hollow interior of drum 13, to stir the heated load 15 of clothes during rotation. This tends to inhibit bunching of the load 15, and speeds the drying process. The impellers 16 are fixedly mounted to the inside of surface 27 of drum 13, and rotate with drum 13. Drum 13 can rotate, i.e., load 15 can be stirred, when the RF power 12 is applied to anode(s) 11, or when it is not applied, or when it is both applied and not applied.

Figure 5:
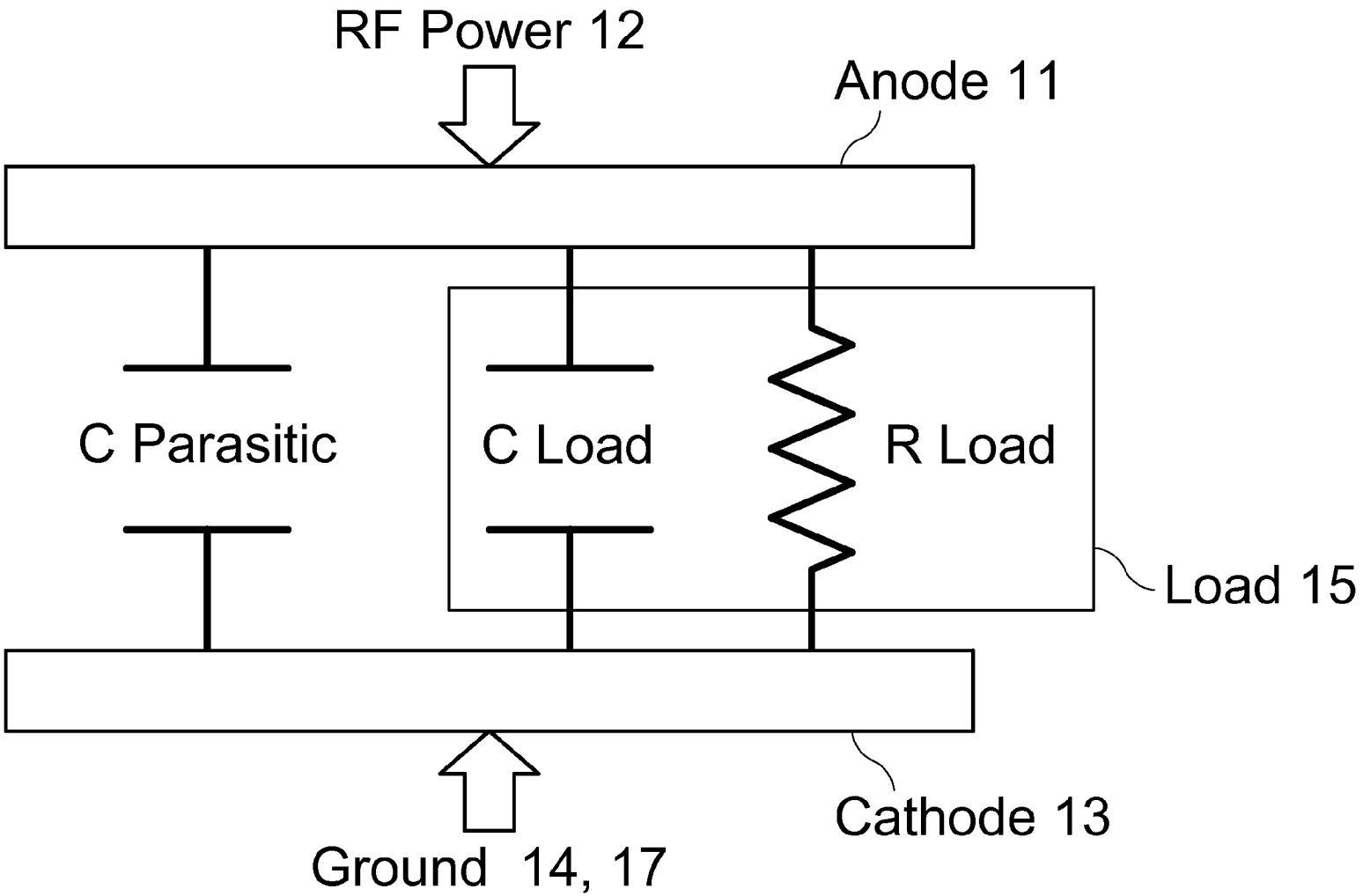
FIG. 5 is an electrical circuit model of load 15 within drum 13.

FIG. 5 is an electrical circuit model of the load 15 inside the drum 13. The load 15 can be represented, electrically, as a lossy capacitor. The radial anode(s) 11 and drum (cathode) 13 are optimized in form and materials to maximize the RF electrical power 12 coupling to the load 15, and to minimize the parasitic drum 13 capacitance.

Figure 6:
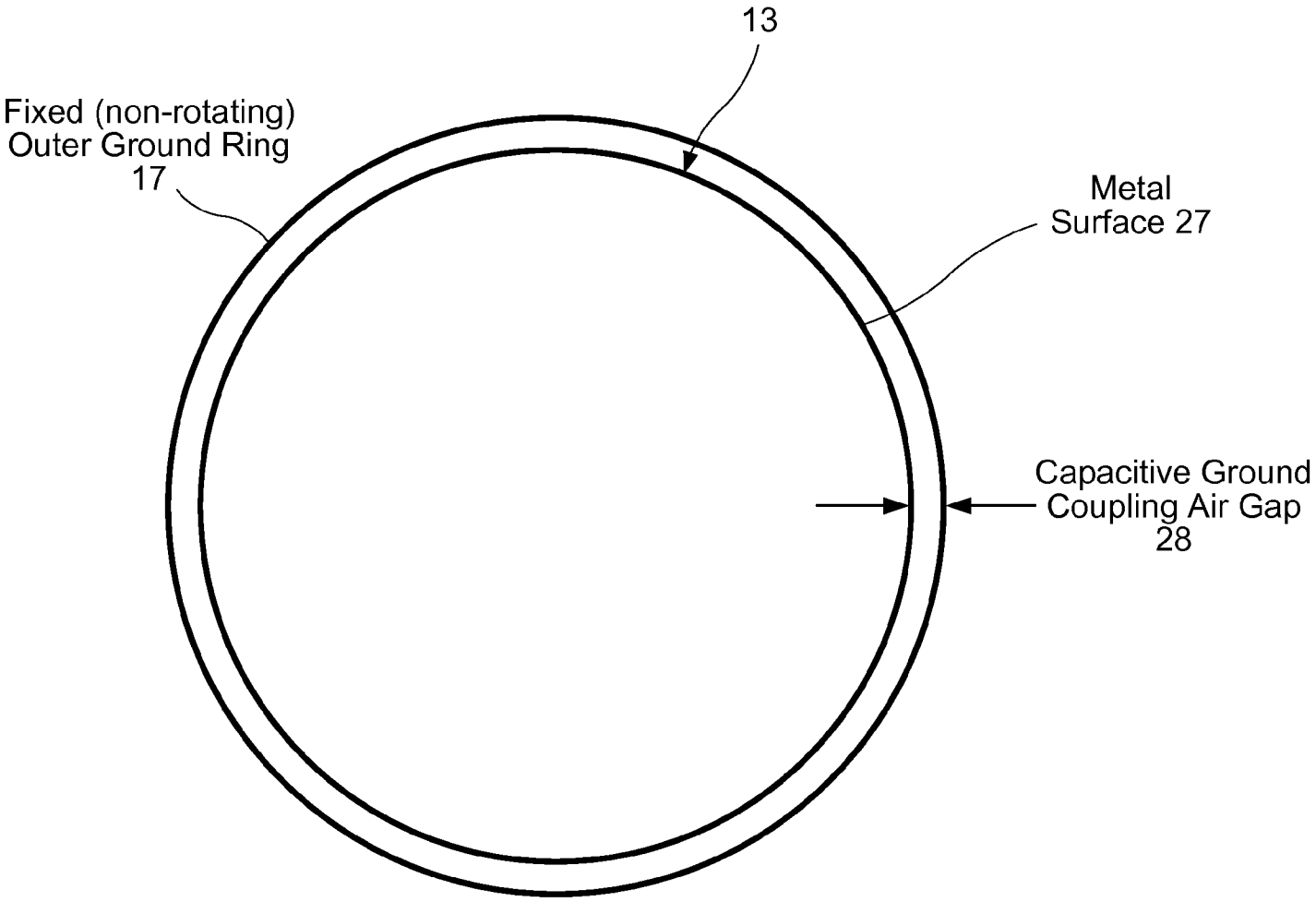
FIG. 6 is a center-cut end view of a ground connection 17 to drum 13 using capacitive coupling 28.

FIG. 6 is a center cut, end view of a typical cathode (ground) connection 17 to the drum 13 using capacitive coupling 28. An exterior electrically conductive ring 17 envelops the drum 13, is stationary, and is grounded to complete the RF circuit. The conductive outer surface 27 of the drum 13 is grounded to ground ring 17 capacitively via air gap 28.

Figure 7:
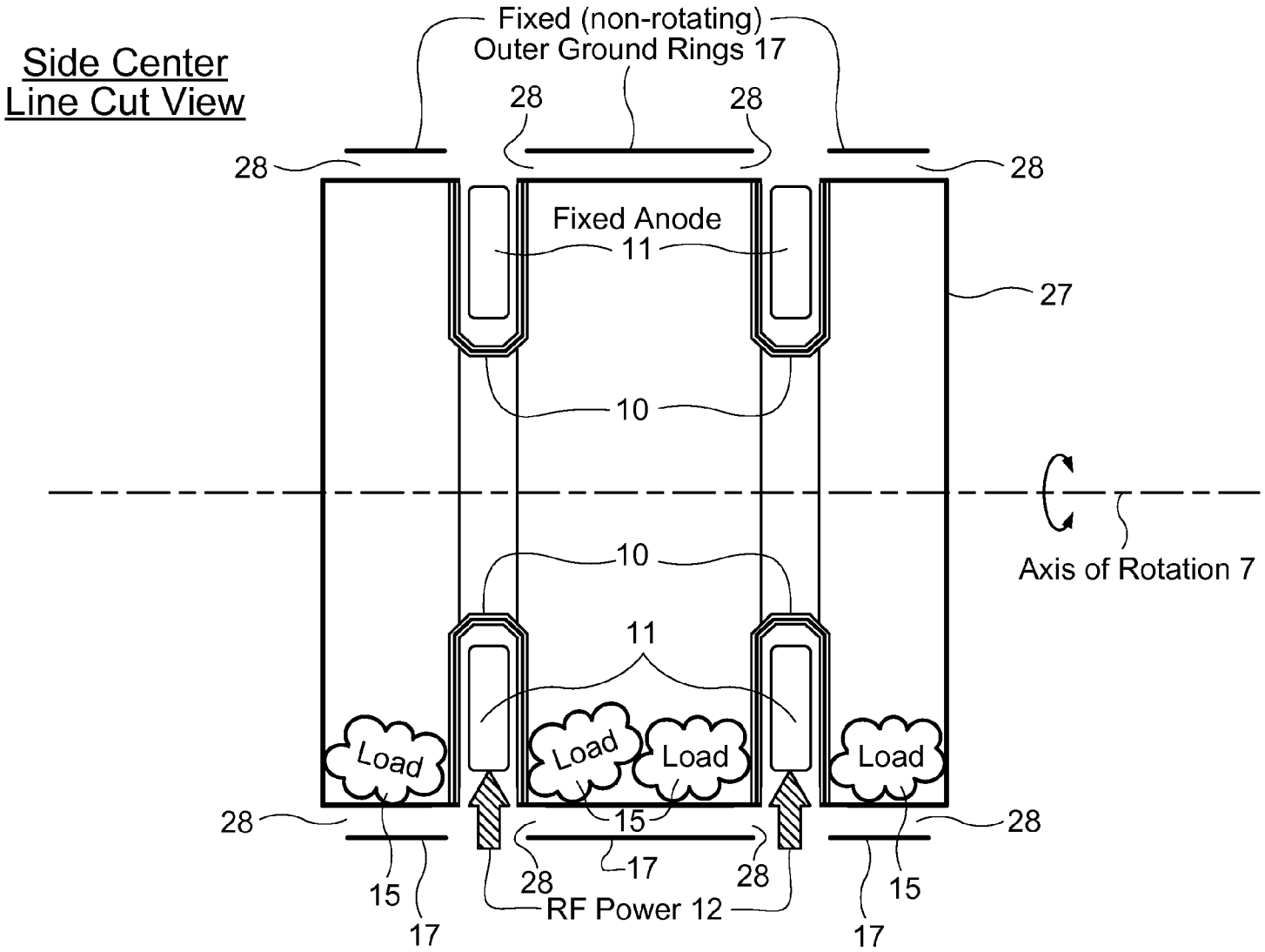
FIG. 7 is a side center-line cut view of an embodiment of a capacitive coupling 28 in which three ground rings 17 are used.

FIG. 7 is a side center line cut view of a cathode capacitive coupling 28 arrangement in which three spatially fixed cylindrical ground rings 17 are used. Each ring 17 is capacitively coupled to outer metallic surface 27 of the metallic dryer drum 13 via capacitive air gap 28.

In an alternative embodiment, as shown in FIG. 1, a single rotating "brush type" ground connection 14 is used to ground drum 13. This ground connection 14 can be an electrically conductive small area or elongated strip that is fabricated as part of electrically conductive surface 27 of drum 13, and rotates with drum 13. During rotation, ground connection 14 is in continuous electrical connection with a spatially fixed ground mass, ensuring continuous grounding of drum 13.

Figure 10:
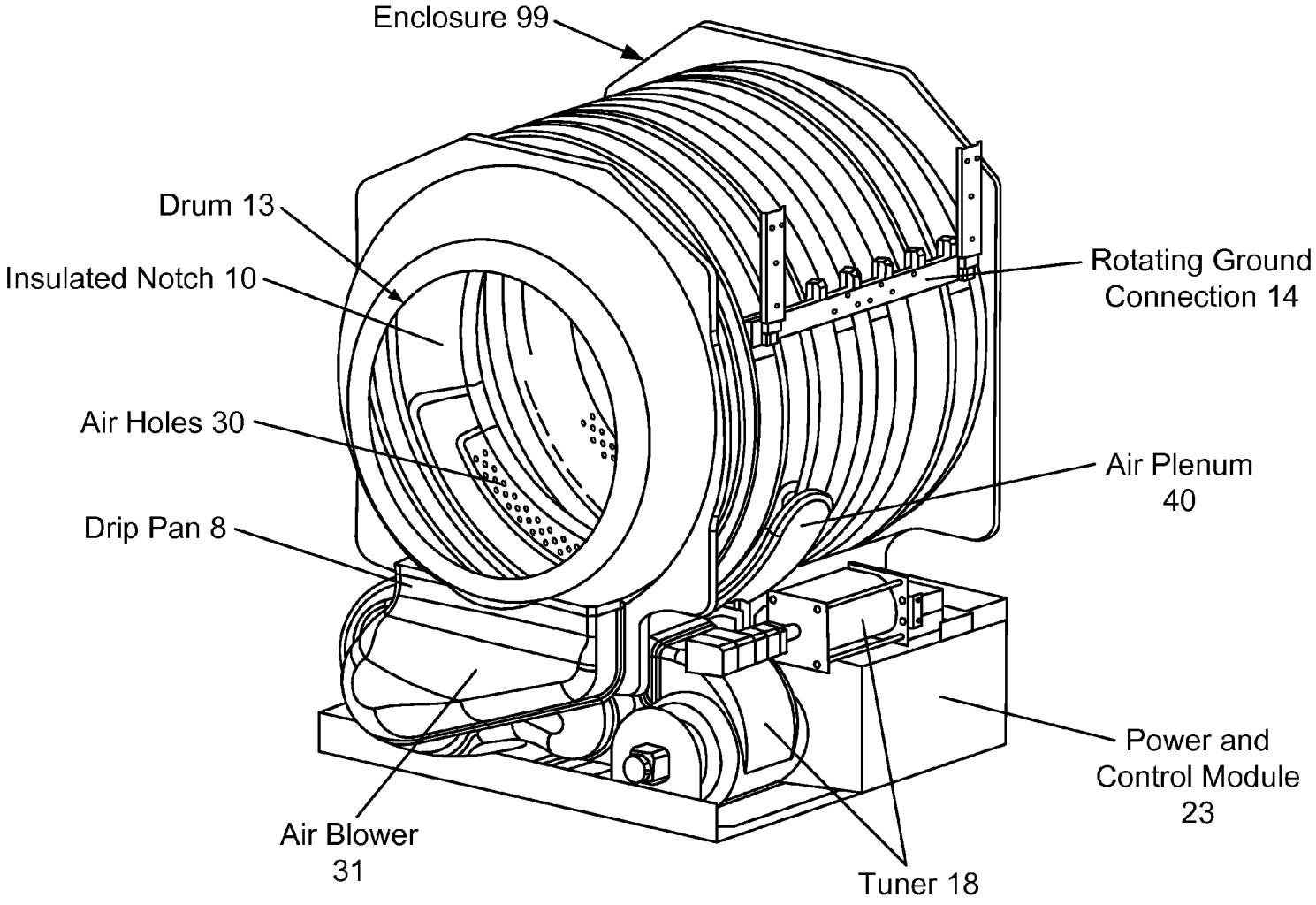
FIG. 10 is a perspective view of an embodiment of the present invention in a clothes dryer apparatus 99, with the door to close the entrance to drum 13 not shown.

Even when the maximum dimension of drum 13 is only a small percentage of the total wavelength dimension at the operating frequency of the applied RF power 12, there can be a far field (electro-magnetic) cavity effect set up within the periphery of the drum 13 as it rotates or sits in its overall enclosure 99 (see FIG. 10). This far field effect in turn causes a distortion of the desired uniform electric field within drum 13, resulting in lower dielectric heating uniformity and overall heating efficiency. For example, a 2-foot diameter by 2-foot long cylindrical cathode drum 13 at 13.56 MHz has a wavelength of only about 10 degrees (360 degrees=72.6 feet). A single point (small area) or strip ground connection 14, as shown in FIG. 1, can improve RF to heat transfer efficiency by up to 10% compared to the wide area connection 17 shown in FIGS. 6 and 7. Another way to minimize this far field parasitic effect is to use the lowest practicable frequency in the selected range to power the anodes 11, given constraints such as component size and cost. The tradeoff is that component size and cost increase as the frequency decreases.

The ground connection 14, 17 can be continuously activated during movement of the drum 13; or grounding can be activated selectively, such as only when drum 13 is not rotating or when it is rotating.

Figure 8:
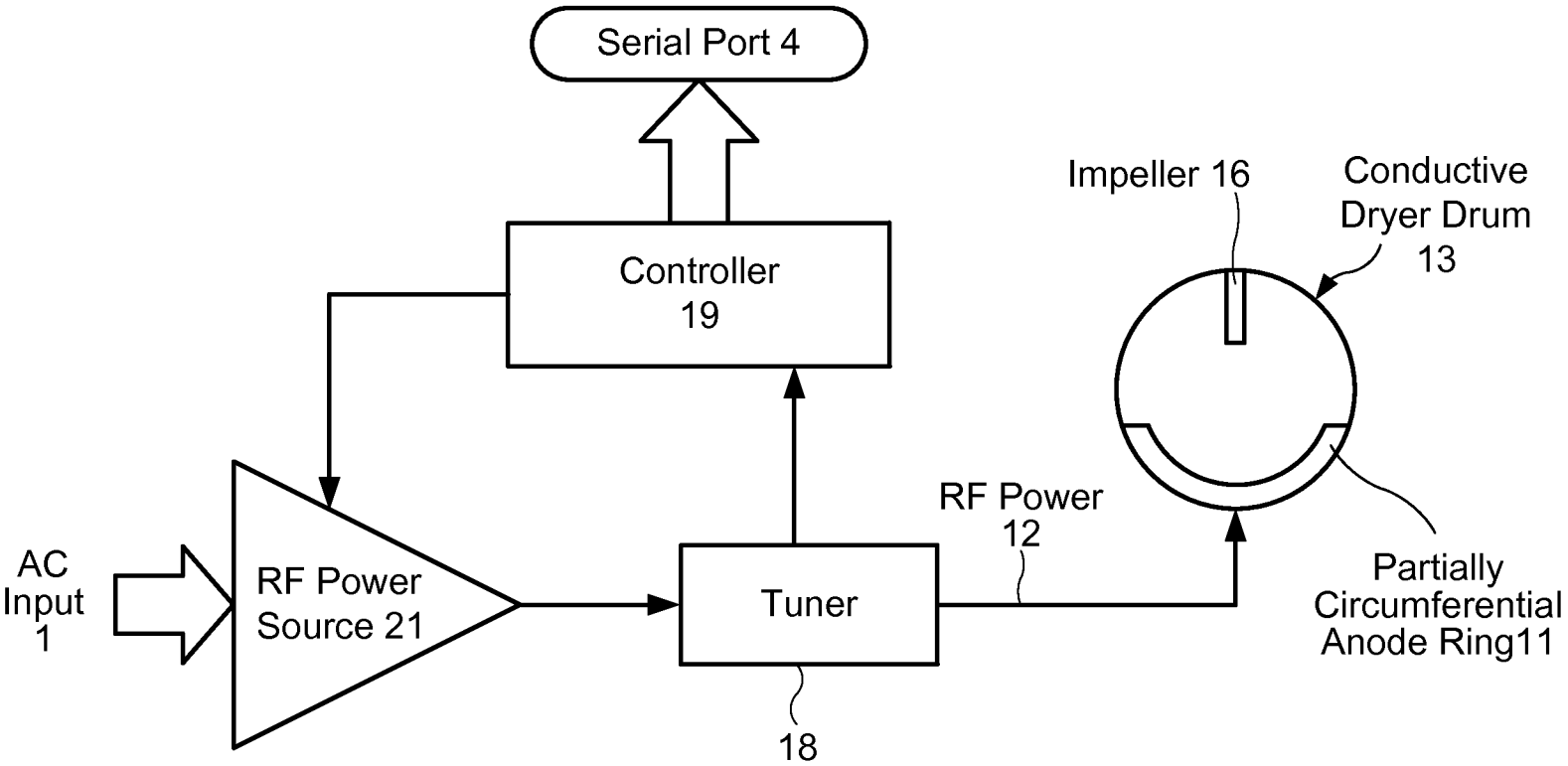
FIG. 8 is a block diagram of a typical RF power source 21, tuner 18, and controller 19 used in conjunction with the present invention.

FIG. 8 shows a typical RF power source 21 used in conjunction with the present invention. The conductive dryer drum 13 is connected to single fixed frequency solid state power source 21 by an RF tuner 18 that, in conjunction with controller 19, measures and determines appropriate power, dryness, load size, and drying end time settings to perform the drying process. The preferred operating frequency of the RF power source 21 is in the range of 1 MHz to 50 MHz.

In one method embodiment, initially the RF power 12 is applied for a set amount of time to the load 15 with the drum 13 in a stationary position, with the clothes 15 forced to the bottom of the drum 13 by gravity. This ensures a continuous close contact of the load 15 to both the insulated notch 10 areas adjacent to the anodes 11 and to the conductive drum 13. Then the drum 13 is rotated, with continuous air flow 25, to fluff the clothes 15 and to facilitate the removal of the evaporated water, again for a preset amount of time. The process is repeated until the desired level of load 15 dryness is obtained. The dryness can be measured by RF sensors coupled to controller 19, to automatically terminate the drying cycle when the preselected dryness level is reached.

Figure 9:
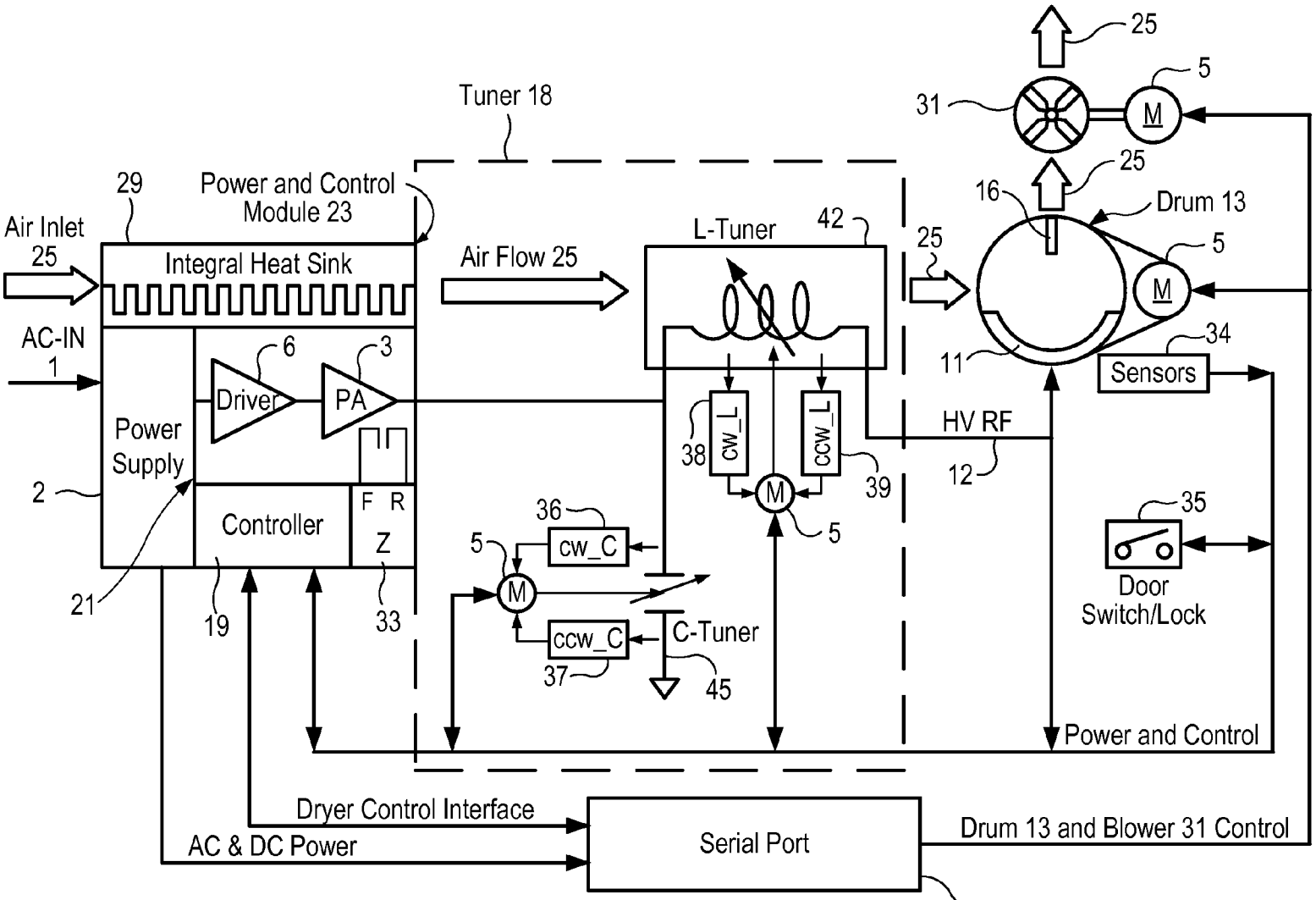
FIG. 9 is a partly schematic, partly block diagram showing an embodiment of the present invention in which unified dryer power and control is achieved.

FIG. 9 is a partly schematic, partly block diagram showing an embodiment of the present invention in which unified, high efficiency, energy conserving dryer power and control is achieved. AC to RF power source 21 and controller 19 are integrated into a single power and control module 23 comprising impedance (Z) measuring module 33, and a power supply 2 adapted to receive AC from input 1 and to output 300V DC to driver 16, which is coupled to power amplifier 3. Power supply 2 also passes the input AC and 15V DC to serial port 4 for providing power to the motors 5 controlling drum 13 and air blower 31. Module 23 can also comprise an integral heat sink 29 to assist in cooling the components within module 23.

Tuner 18 comprises a variable inductor 42 and a variable capacitor 45. In this embodiment, air flow 25 is used as previously described, and also serves to cool variable tuning inductor 42.

The introduced forced air 25 can be room temperature air, heated air, or a combination of both. It is also possible to recover heat from power and control module 23 by blowing air 25 across integral heat sink 29, and subsequently through variable inductor 42, and then to funnel this heated air back into the drum 13 to assist in drying the load 15.

Serial port 4 can be used to change parameters within controller 19 via an outboard computer, or a Graphical User Interface (not illustrated). These parameters can include the preselected degree of dryness that will cause controller 19 to shut down the application of power from RF source 21 in order to end the drying process.

Motors 5 are used to control the tuning of inductor 42 and capacitor 45; the drum rotation speed and direction of rotation of drum 13; and the operation of air blower 31. In the case of variable inductor 42, a clockwise sensor 38 and a counterclockwise sensor 39 feed signals to the corresponding motor 5, indicating the position of the variable tuning mechanism of inductor 42. In the case of capacitor 45, a clockwise sensor 36 and a counterclockwise sensor 37 feed signals to the corresponding motor 5 indicating the position of the tuning mechanism of variable capacitor 45.

Sensors 34 and a Door switch/lock 35 are coupled to controller 19. Sensors 34 measure the load 15 temperature, and parameters of the air flow 25 within drum 13. Switch/lock 35 is adapted to send a signal to controller 19 informing controller 19 whether the door to the drying drum 13 is open or closed, and, if it is closed, whether the door is locked or unlocked. Additionally, controller 19 is adapted to send a control signal to switch/lock 35 to selectively open and close the door, and, if the door is closed, to selectively lock and unlock it. The purpose of the door is, of course, to place clothes 15 into, and to remove them from, the hollow interior of drum 13. For purposes of simplicity, FIG. 10 does not show the (front-loaded) door. The door has a grounded screen to ground 14, 17 to confine possible stray fields inside the drum 13.

In an embodiment, anode rings 11 are limited to short semi-circular generally planar arcs (for instance, less than +/−90 degrees). This enables controller 19 to measure load 15 impedance Z as a function of anode ring 11 angular displacement, as the load 15 is rocked back and forth along the bottom of the drum 13. In this embodiment, the efficiency of the RF power 12 coupling to the load 15 varies as a function of anode ring 11 angular displacement. Knowing this displacement, and measuring the varying impedance Z of the load 15 as a function of ring 11 angular displacement, controller 19 can determine load 15 size and density. This information may be then used by controller 19 to further automate the drying process, as now the wet load 15 can be introduced into the drum 13, and by a combination of rocking the drum 13, coupled with measuring the impedance and power efficiency variation, drying power and time settings can be adroitly determined by controller 19.

Uniform heating of the load 15 can often be better achieved when the load 15 is in a semi-stationary position, when back and forth drum 13 rocking about axis of rotation 7 occurs.

The rate of drum 13 rotation can be tracked by controller 19 to help determine optimum power tuning during the drying cycle as water gradually evaporates from the load 15. The controller 19 can adapt, via software, to the varying impedance Z that the load 15 presents to the applied RF power 12 as the load 15 rocks. As before, when the power 12 is applied to the load 15 for a set amount of time, the drum 13 is rotated, preferably with air flow 25. The air flow 25 can be continuous throughout both heated drying and unpowered tumble cycles. Alternatively, the air flow 25 can be controlled on and off for treatment of specialized loads 15, such as when the clothes 15 contain wrinkles. Again, the air flow 25 can be applied for a preset time, to fluff the clothes 15 and to remove some of the evaporated water.

Controller 19 can perform one or more of the following functions:

Real-time tuning for optimum energy transfer to load 15 using at least one of measured RF power 12 applied to the load 15, changes in the level of RF power 12, the load impedance Z, RF reflection coefficient, VSWR, etc. Controller 19 then uses these measurements to determine type, size, and wetness of the load, as well as an optimum time for terminating the drying process.

Determination of real-time water weight and density, along with user parameters derived from test runs and calculations that allow a more accurate prediction, compared to a conventional clothes dryer, of when to stop the drying process.

Because the evaporation of water from the clothes 15 with applied power 12 is usually a well behaved function of time, controller 19 can develop a graph or table taking into account known observed and calculated parameters, such as amount of water present in the clothes 15 to be evaporated, and how much heat is required to evaporate 1 gram of water (heat of vaporization). An algorithm can then be used to enable controller 19 to forecast total load 15 energy levels applied, and with this information, predict how long the drying cycle should last, as it is continuously observed by controller 19 and correlated to changes in the load impedance/VSWR. This same process can be used to accurately send notification signals or messages to the user, both before drying begins and when the drying process is completed. These messages can be in the form of text messages sent to the user's cell phone, using the SMS protocol, for example.

In another embodiment, dryer operation can be speeded up by presetting variable RF tuning inductor 42, upon initial dryer startup or restart, to a value that will produce a measurable null in the load 15 RF return loss for all load 15 type ranges, then using RF variable capacitor 45 to scan the impedance/VSWR of the load 15 when it is in the dryer 13. This can be done without any user input regarding the size of the load 15. This speeds up the tuning convergence.

Also, starting the tuning process, after a load 15 mixing tumble cycle, at the previous RF heat cycle end tuner element 42, 45 settings can advantageously speed up the tuning process. Varying RF heating levels, drum load stir rotation cycle length and speed, RF heating cycle length, and air flow 25 can be used to optimize drying performance.

FIG. 10 is a perspective view showing an implementation of the fixed radial anode rotary drum 13 in a clothes dryer enclosure 99. Rotating drum 13, rotating ground connection 14, insulated notch 10, air holes 30, air blower 31, drip pan 8, power and control module 23, and tuner 18 are shown. All of these items are housed inside the dryer enclosure 99. The fixed anode ring 11 dimensions are limited to an arc of 120 degrees, less than a full circumference.

The above description is included to illustrate the operation of preferred embodiments, and is not meant to limit the scope of the invention. The scope of the invention is to be limited only by the following claims. From the above discussion, many variations will be apparent to one skilled in the art that would yet be encompassed by the spirit and scope of the present invention.

What is claimed is:

1. A clothes dryer apparatus comprising:

an electrically conductive, grounded, generally cylindrical rotatable drum having a hollow interior adapted to contain a load of wet clothes to be dried;

said drum having a partially indented exterior surface in which at least one generally ring-shaped insulated notch has been formed;

positioned within each notch, an electrically conductive anode, wherein each anode has a generally flat ring shape, is spatially fixed with respect to the rotatable drum, and is electrically isolated from conductive portions of the drum; and coupled to each anode, a source of RF power operable at a single fixed frequency.

2. The apparatus of claim 1 wherein the spatially fixed anodes protrude radially into an outer circumference of the drum but are external to the hollow interior of the drum.

3. The apparatus of claim 1 wherein the insulated notches are spaced apart from their corresponding anodes, thereby allowing the drum to rotate with respect to the spatially fixed anodes.

4. The apparatus of claim 1 wherein at least one of the anodes has a full 360 degree circumference.

5. The apparatus of claim 1 wherein at least one of the anodes is shaped in the form of a generally flat circular arc having less than a full 360 degree circumference.

6. The apparatus of claim 1 wherein the RF power source is a fixed frequency, solid state RF signal generator, operating at a single frequency in the frequency range between 1 MHz and 50 MHz, and produces an electrical field between the anode(s) and the conductive drum, acting as a cathode, with the wet clothes positioned between the anode (s) and the drum and acting as a dielectric medium.

7. The apparatus of claim 1 further comprising an air blower positioned to force room temperature or preheated air into the hollow interior of the drum via air holes in at least one insulated notch, whereby water evaporated from the load by the RF power is removed from the interior of the drum due to the resulting air flow.

8. The apparatus of claim 7 further comprising a drip pan located beneath the air holes, whereby any water leaving the hollow interior through the air holes is collected in the drip pan.

9. The apparatus of claim 7 whereby the air blower is further positioned to recover heat generated by at least one of the RF power source and the variable tuning inductor, and to introduce this recovered heat into the air flow.

10. The apparatus of claim 1 further comprising an automatic programmable controller coupled to the RF power source.

11. The apparatus of claim 10 wherein the controller is adapted to gather measurements of at least one of: parameters of the RF power, changes in RF power level, load impedance, and VSWR values; and to use said measurements to determine type, size, and wetness of the load.

12. The apparatus of claim 10 wherein the controller is adapted to gather measurements of at least one of: parameters of the RF power, changes in RF power levels, load impedance, and VSWR levels; and to use said measurements to determine an optimum time for terminating drying of the load.

13. The apparatus of claim 1 further comprising a ground connection adapted to ground electrically conductive surfaces of the drum.

14. The apparatus of claim 13 wherein said ground connection comprises a single electrically conductive small region or an elongated electrically conductive strip, fabricated as part of an electrically conductive surface of the drum.

15. The apparatus of claim 13 wherein the ground connection comprises at least one generally cylindrical ring capacitively coupled to an outer electrically conductive surface of the drum.

16. A method for drying a load of wet clothes, said method comprising the steps of:

applying RF power to each anode of a capacitor having one or more anodes; wherein:

the load of wet clothes is positioned in a hollow interior of an electrically conductive, grounded, generally cylindrical rotatable drum acting as a cathode of the capacitor;

said drum has a partially indented exterior surface in which at least one generally flat ring shaped insulated notch has been formed; and each anode is electrically conductive, positioned within a notch, has a generally flat ring shape, is spatially fixed with respect to the rotatable drum, and is electrically isolated from conductive portions of the drum.

17. The method of claim 16 wherein the drying method comprises causing the drum containing the wet load to rock back and forth about an axis of rotation during at least a portion of an overall drying cycle.

18. The method of claim 16 wherein the drum rotation can be in either direction about a single axis of rotation, and can have any speed, including zero speed.

19. The method of claim 16 wherein the drum is selectively rotated during at least one of the following three times: when the RF power is applied, when the RF power is not applied, and when the RF power is selectively applied and not applied.

20. The method of claim 16 further comprising blowing air into the hollow interior of the drum.

21. The method of claim 16 wherein the RF power has a single fixed frequency in the range between 1 MHz and 50 MHz.

22. The method of claim 21, wherein the lowest practicable operating frequency within the frequency range is used, in order to minimize far field effects.

23. The method of claim 16 further comprising taking steps to optimize a ground return point of the drum, in order to minimize parasitic capacitance.

* * * * *